United States Patent [19]

Riggs, Jr.

[11] 4,069,130

[45] Jan. 17, 1978

[54] BIPOLAR ELECTRODE AND METHOD FOR CONSTRUCTING SAME

[75] Inventor: Olen L. Riggs, Jr., Bethany, Okla.

[73] Assignee: Kerr-McGee Chemical Corporation, Oklahoma City, Okla.

[21] Appl. No.: 545,015

[22] Filed: Jan. 29, 1975

[51] Int. Cl.[2] ..... C25B 11/02; C25B 11/10

[52] U.S. Cl. ..... 204/268; 204/284; 204/286; 204/290 F

[58] Field of Search ..... 204/290 F, 268, 280, 204/284

[56] References Cited

U.S. PATENT DOCUMENTS

| | | | |
|---|---|---|---|
| 3,676,325 | 7/1972 | Smith et al. | 204/288 |
| 3,752,757 | 8/1973 | Stephenson et al. | 204/256 |
| 3,759,813 | 9/1973 | Raetzsch et al. | 204/256 |
| 3,788,966 | 1/1974 | Stephenson et al. | 204/256 |
| 3,824,173 | 7/1974 | Bouy et al. | 204/284 |
| 3,849,279 | 11/1974 | Barkel | 204/254 |
| 3,859,197 | 1/1975 | Bouy et al. | 204/284 |
| 3,873,437 | 3/1975 | Pulver | 204/254 |
| 3,878,084 | 4/1975 | Schultz et al. | 204/290 F |

*Primary Examiner*—F.C. Edmundson
*Attorney, Agent, or Firm*—William C. Addison

[57] ABSTRACT

An improved bipolar electrode having an anodic member and a cathodic member connected in an assembled position spaced a distance apart via a fastener assembly disposed between the anodic member and the cathodic member. In one aspect of the present invention, a portion of the fastener assembly is constructed of an electrically conductive material and, in this aspect, the fastener assembly establishes electrical continuity between the anodic member and the cathodic member in addition to providing the mechanical interconnection between the anodic member and the cathodic member.

30 Claims, 16 Drawing Figures

BIPOLAR ELECTRODE AND METHOD FOR CONSTRUCTING SAME

CROSS-REFERENCE TO RELATED APPLICATIONS

Related subject matter is disclosed in the patent application, Ser. No. 545,016, entitled "A HYBRID BIPOLAR ELECTRODE", filed on an even date with the present application and assigned to the assignee of the present invention.

BACKGROUND OF THE INVENTION

1. Field of the Invention

The present invention relates generally to an improved bipolar electrode and method for constructing same and, more particularly, but not by way of limitation, to an improved bipolar electrode having an anodic member and a cathodic member connected in a spaced apart relationship.

2. Brief Description of the Prior Art

In the past, many electrolytic cells have been proposed for use in a variety of applications. Various electrodes for use in electrolytic cell applications have also been proposed in the past.

One type of electrolytic cell induced an anode electrode and a cathode electrode immersed in an electrolyte and an electrical power source connected to the anode electrode and the cathode electrode, the positive side of the power source being connected to the anode electrode and the negative side of the power source being connected to the cathode electrode. In this type of electrolytic cell, the electrode functioning as the anode and the electrode functioning as the cathode were generally referred to in the art as "monopolar" electrodes, i.e. each electrode functions as either an anode or a cathode during electrolysis.

Another type of electrolytic cell included an anode electrode and a cathode electrode and at least one electrode interposed between the anode and the cathode electrodes, each of the electrodes interposed between the anode and the cathode electrodes having an anodic member and a cathodic member and being referred to in the art as "bipolar" electrodes. The cathodic member and the anodic member of each bipolar electrode were mechanically connected, and the cathodic member of each of the bipolar electrodes was electrically in series with the anodic members prior and subsequent thereto, i.e. the current flowed through the electrolyte to the cathodic member of the bipolar electrode, through the bipolar electrode and from the anodic member of the bipolar electrode through the electrolyte to the next cathodic member of another bipolar electrode or to the cathodic member of the cathode electrode depending on the number of bipolar electrodes in the electrolytic cell.

In the past, electrodes constructed of a carbon material have been used in the construction of both monopolar electrodes and bipolar electrodes. In some instances, the anodic surfaces were constructed of a carbon material and the cathodic surfaces were constructed of a ferrous material, this type of construction tending to minimize contamination of the electrolyte which results from the electrolytic erosion of many non-carbon anodes.

Bipolar electrodes have been constructed of graphite and, in these instances, the graphite was continuously consumed during electrolysis as a result of oxidation of the graphite surfaces. As the graphite bipolar electrode was consumed, the voltage drop across the electrolytic cell was increased and the temperature of the electrolyte increased with the result being the establishment of an operating temperature range of approximately 25° C to approximately 70° C. At the upper limit of this operating temperature range, the loss of graphite as a result of graphite oxidation was substantially increased and, in some instances, cooling coils were included in the electrolytic cell to cool the electrolyte in an attempt to maintain the electrolyte temperature at a reduced level (approximately fifty degrees Centigrade, for example).

The erosion of the carbon bipolar electrodes caused dimensional instability and resulted in a decreased current efficiency as the carbon bipolar electrode was operated over a period of time. Since the erosion of the carbon bipolar electrodes was not uniform, current density gradients were formed which caused further deleterious effects on the operational characteristics of the electrolytic cell.

In recent years, metal electrodes have been proposed to be operated as anodes in bipolar electrolytic cells, such bipolar electrodes also including a cathodic surface. For example, anodic surfaces of titanium have been proposed with cathodic surfaces bonded thereto and such bipolar electrodes have been proposed for use in chloride brines. A nonconductive film tends to form on exposed titanium anodic surfaces in chloride brines; however, this non-conductive film does not tend to develop on precious metals, such as platinum, for example, and platinum coated titanium anodic surfaces have been utilized in chlor-alkali electrolytic cell applications.

In the past, metal bipolar electrodes have been constructed of titanium sheets bonded to steel plates, the titanium sheets forming the anodic member and the steel plate forming the cathodic member. One problem encountered with such bi-metal bipolar electrodes was that the titanium sheet was deformed via the action of molecular hydrogen migrating through the cathodic member to the anodic member forming an expanded hydride with the titanium. This action resulted in a weakening of the structural integrity of the bond between the titanium sheet and the steel plate and, in many instances, resulted in a separation of the titanium-steel along the bonded surface.

Typical patents disclosing prior art devices of the type generally referred to above are the United States Pat. Nos. 3,759,813, issued to Raetzsch, et al.; 3,732,157, issued to Dewitt; b 3,043,757, issued to Holmes; 3,441,495, issued to Colman; and 3,222,270, issued to Edwards.

SUMMARY OF THE INVENTION

The present invention contemplates an improved bipolar electrode and methods for constructing same and electrolytic cells containing same. The bipolar electrode having an anodic member and a cathodic member maintained in a spaced apart relationship via at least one fastener assembly. The anodic member has a first face and a second face, and the first face operates as an anodic surface during the operation of the electrolytic cell. The cathodic member has a first face and a second face, and the first face operates as a cathodic surface during the operation of the electrolytic cell, the second face of the cathodic member generally facing and being spaced a distance from the second face of the anodic member. At least one fastener assembly is disposed between the anodic member and the cathodic member. Each fastener assembly has one portion connected to the second face of the anodic member and another portion connected to the second face of the cathodic member, the fastener assemblies mechanically connecting the anodic member and the cathodic member.

DESCRIPTION OF THE PREFERRED EMBODIMENTS

Figure 1:
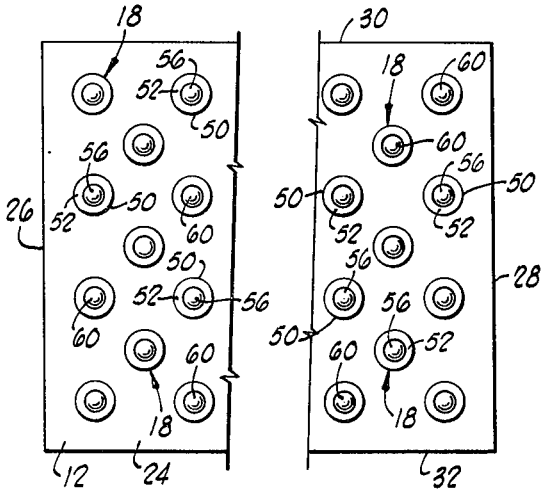
FIG. 1 is an elevational view of the second face of an anodic member and a portion of the fastener assembly constructed in accordance with the present invention.
Figure 2:
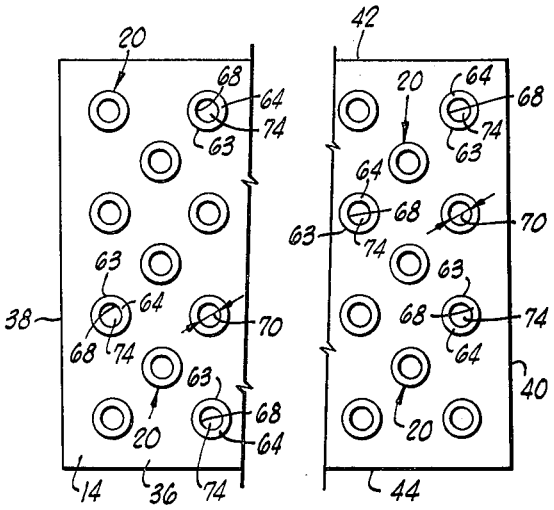
FIG. 2 is an elevational view of the second face of a cathodic member and a portion of the fastener assembly constructed in accordance with the present invention.

Referring to the drawings and to FIGS. 1 through 4 in particular, shown therein and designated via the general reference numeral 10 is a bipolar electrode constructed in accordance with the present invention. In general, the bipolar electrode includes an anodic member 12, a cathodic member 14 and a plurality of fastener assemblies 16 disposed generally between and securing the anodic member 12 and the cathodic member 14 in an assembled and fastened position. Only some of the fastener assemblies are specifically designated in the drawings via the reference numeral 16, for clarity.

The fastener assemblies 16 each include a first fastener element 18 connected to a portion of the anodic member 12 and a second fastener element 20 connected to a portion of the cathodic member 14. Each of the first fastener elements 18 is connectable to one of the second fastener elements 20 for securing the anodic member 12 to the cathodic member 14 in a spaced apart relationship in a fastened position of the fastener assemblies 16 wherein the first fastener element 18 is connected to the second fastener element 20.

The anodic member 12 is generally rectangularly shaped and has a first face 22, a second face 24, a first side 26, a second side 28, a third side 30 and a fourth side 32. The anodic member 12 is constructed such that the first face 22 of the anodic member 12 operates as an anodic surface in an electrolytic cell. In one preferred embodiment, the bipolar electrode 10 is utilized in an alkali metal chlorate or chlorine electrolytic cell for the electrolysis of aqueous solutions of alkali metal chlorides and, in this one preferred embodiment, the anodic member 12 is constructed of a titanium metal sheet having a coating of a noble metal or oxide thereof on the first face 22 such as platinum-iridium, platinum, rubidium, ruthenium osmium and oxides thereof and the like, the coating being electrically conductive and forming the anodic surface on the anodic member 12 (the coating forming the anodic surface not being separately illustrated in the drawings).

The cathodic member 14 is generally rectangularly shaped and has a first face 34, a second face 36, a first side 38, a second side 40, a third side 42 and a fourth side 44. The cathodic member 14 is constructed such that the first face 34 of the cathodic member 14 operates as a cathodic surface in an electrolytic cell. In one preferred embodiment, the bipolar electrode 10 is utilized in an alkali metal chlorate or chlorine electrolyte cell for the electrolysis of aqueous solutions of alkali metal chlorides in a manner mentioned before with respect to the anodic member 12 and, in this one preferred embodiment, the cathodic member 14 is constructed of a carbon steel, stainless steel, or other ferrous materials or non-ferrous materials such as copper, nickle or molybdium, for example, serviceable in chlorate solutions.

Figure 3:
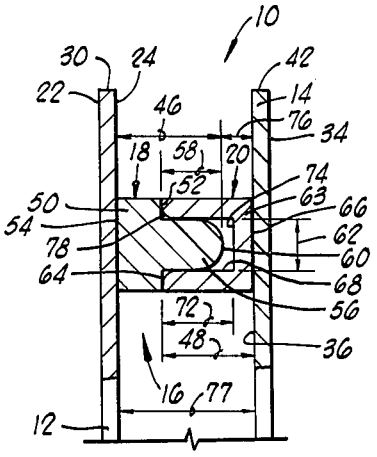
FIG. 3 is a view showing a portion of the anodic member of FIG. 1 secured to a portion of the cathodic member of FIG. 2 via the fastener assembly forming a bipolar electrode constructed in accordance with the present invention, the fastener assembly being enlarged and shown in cross-section.

Each of the first fastener elements 18 is connected to the second face 24 of the anodic member 12 and each of the first fastener elements 18 extends a distance 46 from the second face 24 of the anodic member 12, as shown in FIG. 3. The first fastener elements 18 are spaced on the second face 24 of the anodic member 12 in accordance with a predetermined fastener spacing pattern arranged in a manner to provide a sufficient mechanical interconnection of the anodic member 12 and the cathodic member 14 and, in one preferred form, the fastener assemblies 16 are spaced to accommodate the design current load of the bipolar electrode 10 and to provide a substantially uniform current density on the anodic member 12 and the cathodic member 14.

Figure 4:
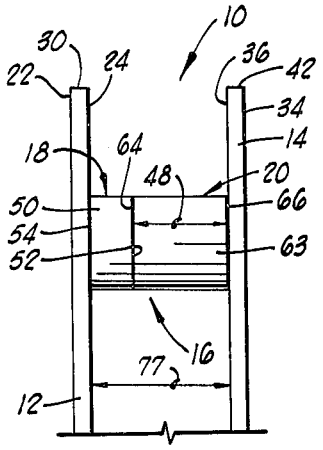
FIG. 4 is a view similar to FIG. 3, but showing the fastener assembly in elevation.

A plurality of the second fastener elements 20 are connected to the second face 36 of the cathodic member 14, and each of the second fastener elements 20 extends a distance 48 from the second face 36 of the cathodic member 14, as shown in FIGS. 3 and 4. The second fastener elements 20 are spaced in accordance with a predetermined fastener spacing pattern substantially identical to the fastener spacing pattern of the first fastener elements 18 on the anodic member 12 and, in an assembled position of the bipolar electrode 10, each of the first fastener elements 18 on the anodic member 12 is substantially aligned with one of the second fastener elements 20 on the cathodic member 14, each of the first elements 18 being connected to one of the second fastener elements 20 in a fastened position thereby mechanically connecting the anodic member 12 and the cathodic member 14.

Each of the first fastener elements 18 includes: a generally cylindrically shaped first base 50, having an upper surface 52 and a lower surface 54; and a rod 56, having opposite ends and an outer peripheral surface. One end of the rod 56 is connected to a central portion of the upper surface 52 of the first base 50 and the rod 56 extends a distance 58 generally perpendicularly therefrom terminating with an outermost end 60, the outermost end 60 being generally opposite the end secured to the first base 50. The rod 56 of each of the first fastener elements 18 is generally cylindrically shaped and has a diameter 62 formed via the outer peripheral surface of the rod 56. In an assembled position, the lower surface 54 of each of the first bases 50 is positioned generally near or adjacent the second face 24 of the anodic member 12 and, in this position, each of the second bases 50 is connected to the second face 24 of the anodic member 12, such as by resistance welding, for example, the first fastener elements 18 being spaced on the anodic member 12 in accordance with the fastener spacing pattern referred to before.

In one preferred embodiment, each of the first fastener elements 18 is constructed of a material capable of conducting electrical current or, in other words, an electrical conductor type of material, and, in this one preferred embodiment, each of the first fastener elements 18, more particularly, is constructed of an electrical conductor material such as titanium, for example, the material of construction of the first fastener elements 18 being electrically compatible with the material of construction of the second fastener elements 20 to assure the required flow and efficient transfer of current from each of the second fastener elements 20 to and through one of the first fastener elements 18 during the operation of the bipolar electrode 10 in an electrolytic cell type of operation.

Each of the second fastener elements 20 includes: a generally cylindrically shaped second base 63, having an upper surface 64 and a lower surface 66. A circularly shaped recess 68, having a diameter 70, is formed in the upper surface 64 of each of the second bases 63, each recess 68 extending a distance 72 into the second base 63 generally from the upper surface 64 toward the lower surface 66 terminating with an end wall 74. The diameter 70 (shown in FIG. 2) of each recess 68 is slightly smaller than the diameter 62 of the rods 56 and the depth (the distance 72) of each recess 68 is greater than the distance 58 which each rod 56 extends from the upper surface 52 of the first base 50 connected thereto. In an assembled position, the lower surface 66 of each of the second bases 63 positioned generally near or adjacent the second face 36 of the cathodic member 14 and, in this position, each of the second bases 63 is connected to the second face 36 of the cathodic member 14, such as by resistance welding, for example, the second fastener elements 20 being spaced on the cathodic member 14 in accordance with the fastener spacing pattern referred to before. In one preferred embodiment, each of the second fastener elements 20 is constructed of a material capable of conducting electrical current or, in other words, an electrical conductor type of material, and, in this one preferred embodiment, each of the second fastener elements 20, more particularly, is constructed of an electrical conductor material such as copper, for example, the material of construction of the second fastener elements 20 being electrically compatible with the material of construction of the first fastener elements 18 to assure the required flow and efficient transfer of current from each of the second fastener elements 20 to and through one of the first fastener elements 18 during the operation of the bipolar electrode 10 in an electrolytic cell type of application.

Each recess 68 formed in the second bases 63 is shaped to matingly and interconnectingly receive the rod 56 of one of the first fastener elements 18 in a fastened position of the fastener assemblies 16, shown in FIGS. 3 and 4. More particularly, each rod 56 is inserted into one of the recesses 68 to an assembled position wherein the upper surface 64 of each of the second bases 63 engages a portion of the upper surface 52 of one of the first bases 50, the engagement between the upper surface 52 of each of the first bases 50 and the upper surface 64 of one of the second bases 63 limiting the movement of the anodic member 12 and the first fastener elements 18 connected thereto in a direction generally toward the second face 36 of the cathodic member 14 and spacing the second face 24 of the anodic member 12 and the first fastener elements 18 connected thereto a distance 77 from the second face 36 of the cathodic member 14. Further, the upper surace 52 of each of the first bases 50 engages a portion of the upper surface 64 of one of the second bases 63 limiting the movement of the cathodic member 14 and the second fastener elements 20 connected thereto in a direction generally toward the second face 24 of the anodic member 12 and spacing the cathodic member 14 and the second fastener elements 20 a distance from the second face 24 of the anodic member 12. In the assembled position of the first and the second fastener elements 18 and 20, the outermost end 60 of each rod 56 is spaced a distance from the end wall 74 formed in the second fastener element 20 connected thereto. In one preferred form, a rounded surface 78 is formed on a portion of the upper surface 64 of each of the second fastener elements 20 and the outermost end 60 of each of the rods 56 is rounded to guidingly facilitate the insertion of the rods 56 into the recesses 68.

Since the diameter 70 of the recesses 68 is slightly smaller than the diameter 62 of the rods 56, each rod 56 is forced into one of the recesses 68, the rods 56 and the recesses 68 being shaped to establish a "force-fit" therebetween for substantially assuring the maximum contacting engagement between the outer peripheral surface of the rods 56 and the peripheral surface formed in the second bases 63 via the recesses 68, thereby establishing electrical continuity between the anodic member 12 and the cathodic member 14 via the fastener assemblies 16 in the one preferred form wherein the fastener assemblies 16 provide electrical continuity between the anodic member 12 and the cathodic member 14. The force-fit interconnection between the first and the second fastener elements 18 and 20 also enhances the structural integrity of the mechanical interlock between the anodic member 12 and the cathodic member 14 provided via the fastener assemblies 16. Further, the fastener assemblies 16 are constructed such that, in an assembled position of the bipolar electrode 10, the second face 24 of the anodic member 12 is spaced a distance 77 from the second face 36 of the cathodic member 14 thereby inhibiting the migration of hydrogen from the cathodic member 14 to the anodic member 12 and substantially reducing titanium hydride embrittlement or the formation of titanium hydride and the resulting deterioration of the titanium anodic member 12 when the bipolar electrode 10 is utilized in an alkali metal chlorate or chlorine electrolytic cell type of application.

The fastener assemblies 16 provide a deliberate gap or spacing between the second face 24 of the anodic member 12 and the second face 36 of the cathodic member 14, i.e. the distance 77 is substantially fixed by the distance 48 between the second face 36 of the cathodic member 14 and the upper surface 64 of the second base 63 and the distance between the upper and the lower surfaces 52 and 54 of the first base 50 of the first fastener elements 16 (the height of the first base 50).

Figure 16:
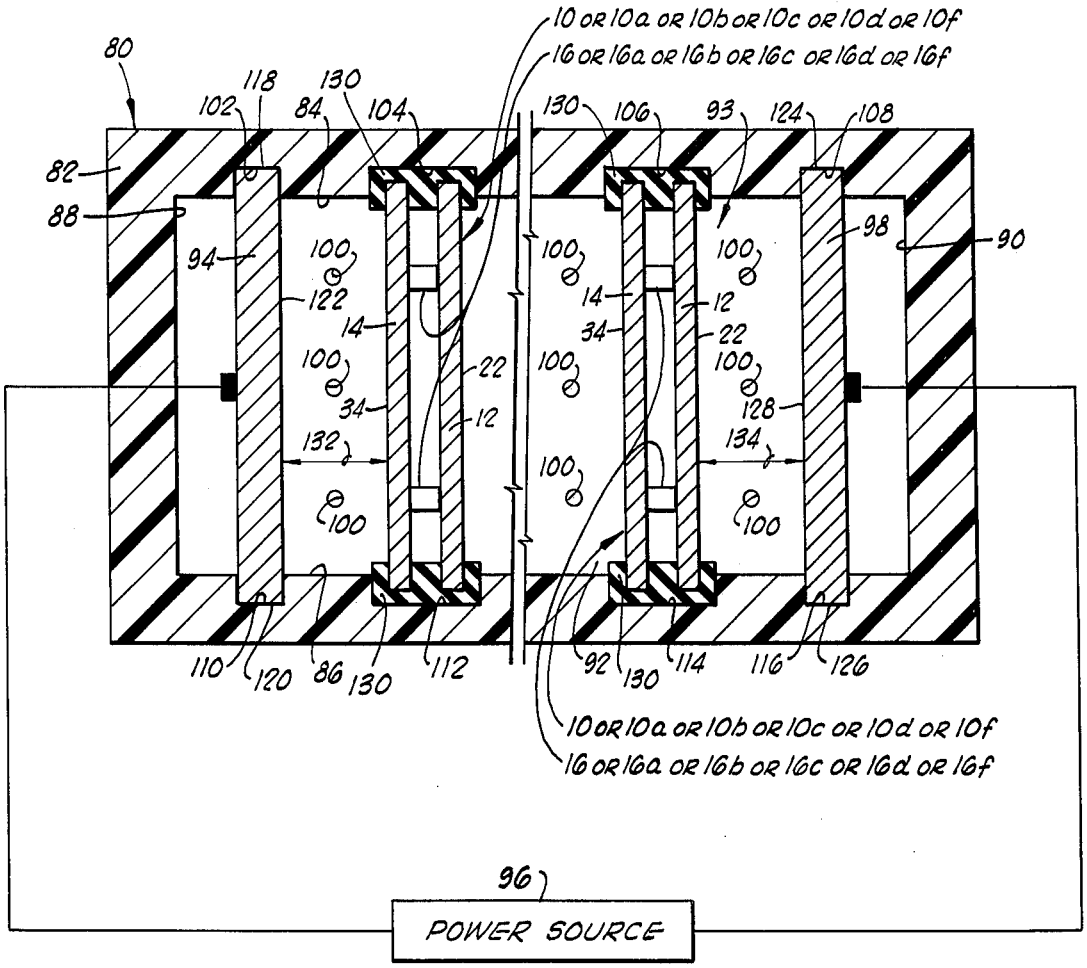
FIG. 16 is a fragmentary, partial sectional, partial elevational view showing the bipolar electrodes of the present invention in an electrolytic cell.

As mentioned before, the bipolar electrodes of the present invention are particularly useful in an alkali metal chlorate or chlorine electrolytic cell for the electrolysis of aqueous solutions of alkali metal chlorides. Diagrammatically and schematically shown in FIG. 16 is an electrolytic cell 80 comprising: a cell box 82 having opposite side walls 84 and 86, opposite end walls 88 and 90 and base 92 defining a space 93 for retaining the electrolyte; a monopolar anodic electrode 94 connected via conventional means to the positive side of an electrical power source 96 (more particularly, a direct-current power source); a monopolar cathodic electrode 98 connected via conventional means to the negative side of the electrical power source 96; and a plurality of bipolar electrodes 10 disposed between the anodic electrode 94 and the cathodic electrode 98 (only the first bipolar electrode 10 next to the monopolar anodic electrode 94 and the last bipolar electrode 10 next to the monopolar cathodic electrode 98 being shown in FIG. 16).

In one form, the cell box 82 includes a plurality of openings 100 formed through the base 92 for introducing the electrolyte into the space 93 formed in the cell box 82. A plurality of channels are formed in the side wall 84, only four channels being shown in FIG. 16 and designated therein via the reference numerals 102, 104, 106 and 108, and a plurality of channels are formed in the side wall 86, each of the channels formed in the side wall 86 being aligned with one of the channels 102, 104, 106 and 108 formed in the side wall 84 (only four channels being shown in FIG. 16 and designated therein via the reference numerals 110, 112, 114 and 116).

The monopolar anodic electrode 94 has opposite sides 118 and 120 and a surface 122 operating as an anodic surface during the operation of the electrolytic cell 80. The aligned channels 102 and 110 are sized and positioned to slidingly receive the anodic electrode 94, and the anodic electrode 94 is supported within the space 93 and extends between the side walls 84 and 86, the anodic electrode 94 being at least partially immersed in the electrolyte during the operation of the electrolytic cell 80.

The monopolar cathodic electrode 98 has opposite sides 124 and 126 and a surface 128 operating as a cathodic surface during the operation of the electrolytic cell 80. The aligned channels 108 and 116 are sized and positioned to slidingly receive the cathodic electrode 98, and the cathodic electrode 98 is supported within the space 93 and extends between the side walls 84 and 86, the cathodic electrode 98 being at least partially immersed in the electrolyte during the operation of the electrolytic cell 80.

Assuming the electrolytic cell 80 included only the monopolar electrodes 94 and 98, the electrical power source 96 would be connected to the monopolar electrodes 94 and 98, and the current would flow from the anodic surface 122, through the electrolyte in the space 93, and to the cathodic surface 128. The anodic surface 122 and the cathodic surface 128 are spaced a distance apart and the electrolyte is disposed generally between the anodic surface 122 and the cathodic surface 128. Further, the anodic monopolar electrode 94 is not mechanically connected to the cathodic electrode 98. Assuming further that the electrolytic cell 80 included a plurality of monopolar anodic electrodes and a plurality of monopolar cathodic electrodes, the monopolar anodic electrodes would be connected in parallel to the electrical power source and the monopolar cathodic electrodes would be connected in parallel to the electrical power source. This type of arrangement just described would constitute a typical prior art monopolar electrode type of electrolytic cell configuration.

The present invention is directed to an electrolytic cell which includes at least one bipolar electrode, in contrast to the electrolytic cell which includes only monopolar electrodes described above. Thus, the electrolytic cell 80, shown in FIG. 16, includes the monopolar anodic electrode 94, the monopolar cathodic electrode 98 and one or more of the bipolar electrodes 10 of the present invention supported within the cell box 82 space 93, generally between the monopolar electrodes 94 and 98, and at least partially immersed in the electrolytic during the operation of the electrolytic cell 80.

The bipolar electrode 10 includes a seal member 130 (shown in FIG. 16) extending generally about the sides 26, 28, 30 and 32 of the anodic member 12 and generally about the sides 38, 40, 42 and 44 of the cathodic member 14. A portion of the seal member 130 sealingly engages the cathodic member 14 and a portion of the seal member 130 sealing engages the anodic member 12 forming a fluid seal between the anodic member 12 and the cathodic member 14 to substantially seal the electrolyte from the space between the second face 24 of the anodic member 12 and the second face 36 of cathodic member 14. Thus, a substantial portion of the space between the second faces 24 and 36 of the anodic and the cathodic members 12 and 14 (depending generally on the size, type and position of the seal member 130, for example) is sealingly isolated from the electrolyte solution during the operation of the electrolytic cell 80.

The aligned channels 104 and 112 in the cell box 82 are sized and positioned to slidingly receive one of the bipolar electrodes 10 of the present invention (the bipolar electrode 10 sometimes referred to herein in connection with FIG. 16 as the first bipolar electrode 10), and the aligned channels 106 and 114 in the cell box 82 are sized and positioned to slidingly receive another bipolar electrode 10 constructed in accordance with the present invention (the bipolar electrode 10 sometimes referred to herein in connection with FIG. 16 as the last bipolar electrode 10). Each of the bipolar electrodes 10 is supported within the space 93 and extends between the side walls 84 and 86. The channels 102, 104, 106, 108, 110, 112, 114 and 116, are positioned to support the electrodes 10, 94 and 98 in a spaced apart relationship. The bipolar electrodes 10 are each oriented such that the anodic surface formed on the first face 24 of the anodic member 12 generally faces and is spaced a distance from the cathodic surface formed on either the monopolar cathodic electrode 98 or the next bipolar electrode 10 and the cathodic surface formed on the first face 34 of the cathodic member 14 generally faces and is spaced a distance from the anodic surface formed on either the monopolar anodic electrode 94 or the next bipolar electrode 10, the cathodic member 14 and the anodic member 12 of each bipolar electrode 10 being mechanically connected and in electrical series. For example, in an assembled position of the electrolytic cell 80, the anodic surface 122 formed on the monopolar anodic electrode 94 is spaced a distance 132 from the cathodic surface formed on the first face 34 of the first bipolar electrode 10 in a direction generally from the monopolar anodic electrode 94 toward the monopolar cathodic electrode 98; the anodic surface formed on the first face 22 of the first bipolar electrode 10 is spaced a distance from the cathodic surface formed on the first face 34 of the next bipolar electrode 10 (not shown in FIG. 16) in a direction generally from the monopolar anodic electrode 94 toward the monopolar cathodic electrode 98; and the anodic surface formed on the first face 22 of the last bipolar electrode 10 in the electrolytic cell 80 is spaced a distance 134 from the cathodic surface 128 formed on the monopolar cathodic electrode 98. During the operation of the electrolytic cell 80 of the present invention, the current flows from the anodic surface 122 of the monopolar anodic electrode 12 through the electrolyte to the cathodic surface formed on the first face 34 of the first bipolar electrode 10; the current flows through the first bipolar electrode 10 from the cathodic member 14 to the anodic member 12 via the fastener assemblies 16; the current flows from the anodic surface formed on the first face 22 of the first bipolar electrode 10 through the electrolyte to the cathodic surface formed on the first face 34 of the next bipolar electrode 10 (not shown in FIG. 16); the current flows through the electrolyte to the cathodic surface formed on the first face 34 of the last bipolar electrode 10; the current flows through the last bipolar electrode 10 from the cathodic member 14 to the anodic member 12 via the fastener assemblies 16; and finally the current flows from the anodic surface formed on the first face 22 of the last bipolar electrode 10 through the electrolyte to the cathodic surface 128 formed on the monopolar cathodic electrode 98. It should be noted that the current flow to, through and from the bipolar electrodes 10 intermediate or disposed between the first and the last bipolar electrodes 10 has not been referred to in detail in the foregoing description.

In summary, the cathodic surface on the cathodic member 14 is mechanically connected to the anodic surface on the anodic member 12 of each bipolar electrode, and the cathodic surface and the anodic surface of each bipolar electrode 10 are in electrical series. In addition, the anodic surface of each bipolar electrode 10 generally faces and is spaced a distance from a cathodic surface of either the monopolar cathodic electrode or one of the other bipolar electrodes 10, and the current flows from the anodic surface of each bipolar electrode 10, through the electrolyte, to the cathodic surface of either the monopolar cathodic electrode or one of the other bipolar electrodes 10. The cathodic surface of each bipolar electrode 10 generally faces and is spaced a distance from an anodic surface of either the monopolar anodic electrode or one of the other bipolar electrodes 10 and the current flows from the cathodic surface to the anodic surface via the fastener assemblies of each bipolar electrode 10.

During the operation of the electrolytic cell 80, the electrolyte is introduced into the space 93 of the cell box 82 via the openings 100, and the electrolyte is removed from the space 93 of the cell box 82 by overflowing over the top (not shown) of the cell box 82 or, in some instances, by passing the electrolyte through openings (not shown) in the cell box 82 generally near the top thereof. In some applications, the cell box 82 is supported within a larger cell tank (not shown) and the electrolyte is retained within the cell tank circulated into the cell box 82 from the cell tank, removed from the cell box 82 and circulated back into the cell tank, a cooling coil being disposed in the cell tank in contact with the electrolyte for maintaining the electrolyte at a predetermined temperature level during the electrolysis operation. The construction and operation of cell boxes and cell tanks and the use of cell boxes in electrolytic applications is well known in the art, and a further detailed description is not required herein.

It is significant to note again that the fastener assemblies 16 are connected to the second faces 24 and 36 of the anodic member 12 and the cathodic member 14, respectively, and the fastener assemblies 16 are constructed such that openings do not have to be formed through the first faces 22 or 34 of either the anodic member 12 or the cathodic member 14 to accommodate any portion of the fastener assemblies 16, thereby eliminating the sealing problems associated with attempting to provide a fluid seal between some type of fastener construction and the openings through the first faces 22 or 34 of the anodic electrode and the cathodic electrode 14 to prevent leakage of the electrolyte into the space between the second faces 24 and 36 of the anodic member 12 and the cathodic member 14. Further, since the fastener assemblies 16 do not extend through and beyond the first faces 22 and 34 of the anodic member 12 and the cathodic member 14, the spacing between the bipolar electrodes 10 and the spacing between the bipolar electrode 10 and a monopolar electrode in an electrolytic cell can be determined independent of the fastener assemblies 16, i.e. the fastener assemblies 16 do not extend into the space between the bipolar electrodes 10 or the space between the bipolar electrode 10 and a monopolar electrode. In summary, the fastener assemblies 16 are constructed and disposed to provide the maximum positive contact surface area between the first and the second fastener elements for the purpose of current transfer efficiency therebetween and mechanical interlock integrity, to provide an interlock for securing the anodic member 12 and the cathodic member 14 in a spaced apart relationship wherein the elements of the fastener assemblies 16 forming the interlock are manufacturable in a manner reducing any specialized machining time and to provide a mechanical interlock wherein the elements forming the interlock are positionable on and secured to the anodic member 12 and the cathodic member 14 in a relatively fast, accurate and efficient manner.

Figure 5:
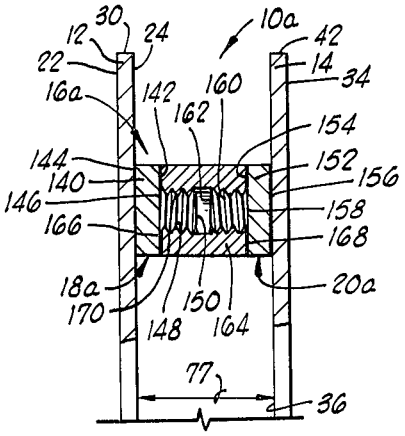
FIG. 5 is a view similar to FIG. 3, but showing the anodic member connected to the cathodic member via a modified fastener assembly.

Embodiment of FIG. 5

Shown in FIG. 5 is a modified bipolar electrode 10*a* which is constructed exactly like the bipolar electrode 10 described before, except the bipolar electrode 10*a* includes a pluraltiy of modified fastener assemblies 16*a*, each having a modified first fastener element 18*a* and a modified second fastener element 20*a* (only one of the fastener assemblies 16*a* being shown in FIG. 5).

Each of the first fastener elements 18*a* includes a first base 140, having an upper surface 142 and a lower surface 144. One end 146 of a first threaded member 148 is connected to a central portion of the upper surface 142 of each of the first bases 140, each of the first threaded members 148 extending a distance from the upper surface 142 terminating with an opposite, outermost end 150. The lower surface 144 of each of the first bases 140 is positioned adjacent the second face 24 of the anodic member 12 and each first base 140 is connected to the second face 24, such as by resistance welding, for example. The first fastener elements 18*a* are positioned and spaced on the second face 24 of the anodic member 12 in accordance with the predetermined fastener spacing pattern in a manner and for reasons like that described before with respect to the bipolar electrode 10, shown in FIGS. 1 through 4.

Each of the second fastener elements 20*a* is constructed similar to the first fastener elements 18*a* and includes a second base 152 having an upper surface 154 and a lower surface 156.

One end 158 of a second threaded member 160 is connected to a central portion of the upper surface 154 of each of the second bases 152, each of the second threaded members 160 extending a distance from the upper surface 154 terminating with an opposite, outermost end 162. The lower surface 156 of each second base 152 is positioned adjacent the second face 36 of the cathodic member 14 and each second base 152 is connected to the second face 36, such as by resistance welding, for example. Each of the second fastener elements 20*a* and, more particularly, each of the second threaded members 160 of the second fastener elements 20*a* is aligned with one of the first threaded members 148 of the first fastener elements 18*a*, and the second fastener elements 20*a* are positioned and spaced on the second face 36 of the cathodic member 14 in accordance with the predetermined fastener spacing pattern in a manner and for reasons like that described before with respect to the bipolar electrode 10, shown in FIGS. 1 through 4.

The first and the second threaded members 148 and 160 are counter-threaded, i.e. one of the first and the second threaded members 148 or 160 has right-hand threads and the other of the first and the second threaded members 148 or 160 has left-hand threads. Each of the fastener assemblies 16*a* includes a nipple 164, having opposite ends 166 and 168 and a threaded opening 170 extending axially therethrough intersecting the opposite ends 166 and 168, the nipples 164 being more particularly counter-threaded nipples, i.e. the threaded portion of the opening 170 generally adjacent one of the ends 166 or 168 has right-hand threads and the threaded portion of the opening 170 generally adjacent the opposite end 166 or 168 has left-hand threads.

In an assembled position of the bipolar electrode 10*a*, a portion of the first threaded member 148 generally adjacent the outermost end 150 thereof is disposed a distance through and threadedly engages a portion of the threaded opening 170 in the nipple 164 generally adjacent the end 168 thereof, and a portion of the second threaded member 160 generally adjacent the outermost end 162 thereof is disposed a distance through and threadedly engages a portion of the threaded opening 170 in the nipple 164 generally adjacent the end 166 thereof. Since the nipple 164 is counter-threaded in a manner corresponding to the first and the second threaded members 148 and 160, the anodic member 12 will be moved toward the cathodic member 14 as the nipple 164 is rotated in one direction threadedly disposing each of the first and the second threaded members 148 and 160 in the opposite ends of the threaded opening 170 in the nipple 164, thereby securing the anodic member 12 and the cathodic member 14 in a spaced apart relationship in a manner and for reasons similar to that described before with respect to the bipolar electrode 10.

The first and the second threaded members 148 and 160 are each sized and the nipple 164 has a length between the opposite ends 166 and 168 thereof such that, in an assembled position, the end 150 of the first threaded member 148 is spaced a distance from the end 162 of the second threaded member 160, the end 168 of the nipple 164 abutting the upper surface 142 of the first base 140 and the end 166 abutting the upper surface 154 of the second base 152 limiting the movement of anodic member 12 toward the cathodic member 14 and positioning the anodic member 12 and the cathodic member 14 in a spaced apart relationship in a manner and for reasons like that described before with respect to the fastener assemblies 16 of the bipolar electrode 10 shown in FIGS. 1 through 4. It should be noted that the foregoing description would particularly apply in those instances where the first and the second threaded members 148 and 160 are simultaneously engaged via the nipple 164. However, even in those instances where the first and the second threaded members 148 and 160 are not precisely simultaneously engaged via the nipple 164, either the end 168 of the nipple 164 will abut the first base 140 or the end 166 of the nipple 164 will abut the second base 152 and, in either event, the movement of the anodic member 12 toward the cathodic member 14 is limited thereby mechanically connecting the anodic member 12 and the cathodic member 14 in the spaced apart relationship.

Thus, the fastener assembly 16*a* is constructed such that the second base 152 is engageable with one end of the nipple 164 limiting the movement of the first fastener elements 18*a* and the anodic member 12 connected thereto in a direction generally toward the second face 36 of the cathodic member 14 and spacing the first fastener elements 18*a* and the anodic member 12 a distance from the second face 36 of the cathodic member 14. Further, the first base 140 is engageable with one end of the nipple 164 limiting the movement of the second fastener element 20*a* and the cathodic member 14 in a direction generally toward the second face 24 of the anodic member 12 and spacing the second fastener elements 20*a* and the cathodic member 14 a distance from the second face 24 of the anodic member 12. If the first and the second threaded members 148 and 160 are simultaneously engaged via the nipple 164, then the first and the second bases 140 and 152 will each engage the nipple 164. In those instances where the first and the second threaded members 148 and 160 are not precisely simultaneously engaged via the nipple 164 or even if the first and the second bases 140 and 152 are not precisely the same size, either the first base 140 or the second base 152 will engage the nipple 164, and, in either event, the engagement between the nipple 164 and either the first base 140 or the second base 152 limits the movement of the anodic member 12 toward the cathodic member 14 and secures the anodic member 12 and the cathodic member 14 in an assembled, spaced apart relationship.

In a preferred embodiment, the bipolar electrode 10*a* is constructed to be utilized in an alkali metal chlorate or chlorine electrolytic cell for the electrolysis of aqueous solutions of alkali metal chlorides in a manner described before with respect to the bipolar electrode 10 shown in FIGS. 1 through 4. The bipolar electrode 10*a* is shown in FIG. 16 in the electrolytic cell 80 and the bipolar electrode 10*a* will operate in a manner like that described before with respect to the bipolar electrode 10 and the electrolytic cell 80. The first and the second threaded members 148 and 160 are constructed of an electrically conductive material, each of the first and the second threaded members 148 and 160 being constructed of copper in one preferred form, and the first threaded members 148 being constructed of titanium and the second threaded members 160 being constructed of carbon steel, in one other preferred form. The nipple 164 is preferably constructed of an electrically conductive material and, more particularly, copper, in a preferred form.

Figure 6:
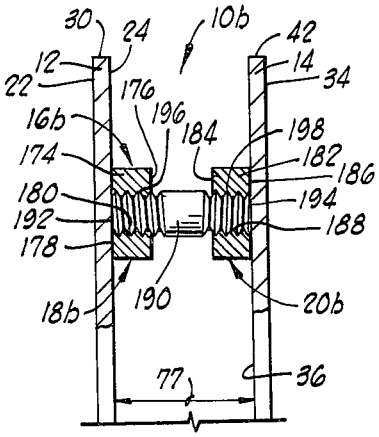
FIG. 6 is a view similar to FIG. 3, but showing the anodic member connected to the cathodic member via another modified fastener assembly.

Embodiment of FIG. 6

Shown in FIG. 6 is another modified bipolar electrode 10*b* which is constructed exactly like the bipolar electrode 10 described before, except the bipolar electrode 10*b* includes a plurality of modified fastener assemblies 16*b*, each having a modified first fastener element 18*b* and a second fastener element 20*b*.

Each of the first fastener elements 18*b* includes a first base 174, having an upper surface 176, a lower surface 178 and a threaded opening 180 formed through a central portion thereof intersecting the upper surface 176. The lower surface 178 of each first base 174 is positioned adjacent the second face 24 of the anodic member 12 and each first base 174 is connected to the second face 24, such as by resistance welding, for example. The first fastener elements 18*b* are positioned and spaced on the second face 24 of the anodic member 12 in accordance with the predetermined fastener spacing pattern in a manner and for reasons like that described before with respect to the bipolar electrode 10, shown in FIGS. 1 through 4.

Each of the second fastener elements 20*b* includes a second base 182, having an upper surface 184, a lower surface 186 and a threaded opening 188 formed through a central portion thereof intersecting the upper surface 184. The lower surface 186 of each second base 182 is positioned adjacent the second face 36 of the cathodic member 14 and each second base 182 is connected to the second face 36, such as by resistance welding, for example. The second fastener elements 20*b* are positioned and spaced on the second face 36 of the cathodic member 14 in accordance with the predetermined fastener spacing pattern in a manner and for reasons like that described before with respect to the bipolar electrode 10 shown in FIGS. 1 through 4.

The threaded openings 180 and 188 are counter-threaded, i.e. one of the threaded openings 180 or 188 has right-hand threads and the other threaded opening 180 or 188 has left-hand threads. Each of the fastener assemblies 16*b* includes a threaded member 190 having opposite ends 192 and 194 and opposite threaded portions 196 and 198. The threaded portions 196 and 198 are counter-threaded, i.e. one of the threaded portions 196 or 198 has right-hand threads and the other threaded portion 196 or 198 has left-hand threads.

In an assembled position of the bipolar electrode 10*b*, a portion of the threaded member 190 generally adjacent the end 192 is threadedly disposed through the threaded opening 180 in the first base 174 and a portion of the threaded member 190 generally adjacent the end 194 thereof is threadedly disposed through the threaded opening 188 in the second base 182. Since the threaded member 190 is counter-threaded in a manner corresponding to the threaded openings 180 and 188 in the first and the second bases 174 and 182, the anodic member 12 will be moved toward the cathodic member 14 as the threaded member 190 is rotated in one direction, thereby securing the anodic member 12 and the cathodic member 14 in a spaced apart relationship in a manner and for reasons like that described before with respect to the fastener assemblies 16 of the bipolar electrode 10 shown in FIGS. 1 through 4.

The threaded opening 180, more particularly, intersects the upper and the lower surfaces 176 and 178 of the first base 174, and the threaded opening 188, more particularly, intersects the upper and the lower surfaces 184 and 186 of the second base 182. Thus, as the threaded member 190 is rotated the end 192 of the threaded member 190 is moved toward the second face 24 of the anodic member 12 and the end 194 of the threaded member 190 is moved toward the second face 36 of the cathodic member 14. If the threaded openings 180 and 188 are simultaneously engaged via the threaded member 190, the end 192 of the threaded member 190 will abut the second face 24 of the anodic member 12 and the end 194 of the threaded member 190 will abut the second face 36 of the cathodic member 14, thereby limiting the movement of the anodic and the cathodic members 12 and 14 in a direction generally toward the other member 12 or 14. Even if the threaded openings 180 and 182 are not precisely simultaneously engaged via the threaded member 190 or even if the first and the second bases 174 and 182 are not precisely the same size, either the end 192 of the threaded member 190 will abut the second face 24 of the anodic member 12 or the end 194 of the threaded member 190 will abut the second face 36 of the cathodic member 14, and, in either event, the engagement between the threaded member 190 and either the second face 24 of the anodic member 12 or the second face 36 of the cathodic member 14 limits the movement of the anodic member 12 toward the cathodic member 14 and secures the anodic member 12 and the cathodic member 14 in an assembled, spaced apart relationship.

In a preferred form, the bipolar electrode 10*b* is constructed to be utilized in an alkali metal chlorate or chlorine electrolytic cell for electrolysis of aqueous solutions of alkali metal chlorides in a manner described before with respect to the bipolar electrode 10 shown in FIGS. 1 through 4. The bipolar electrode 10*b* is shown in FIG. 16 in the electrolytic cell 80 and the bipolar electrodes 10*b* will operate in a manner like that described before with respect to the bipolar electrode 10 and the electrolytic cell 80. The first bases 172 preferably are constructed of an electrically conductive material, each of the first bases 172 being constructed of titanium, for example, in one preferred form, and each of the second bases 182 preferably are constructed of an electrically conductive material, each of the second bases 182 being constructed of copper or carbon steel, for example, in one preferred form.

Figure 7:
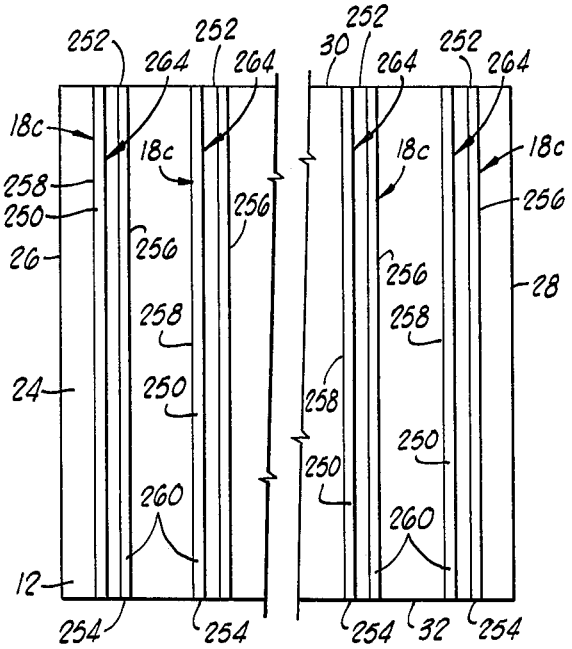
FIG. 7 is an elevational view showing the second face of the anodic member similar to FIG. 1, but showing a portion of yet another modified fastener assembly.
Figure 8:
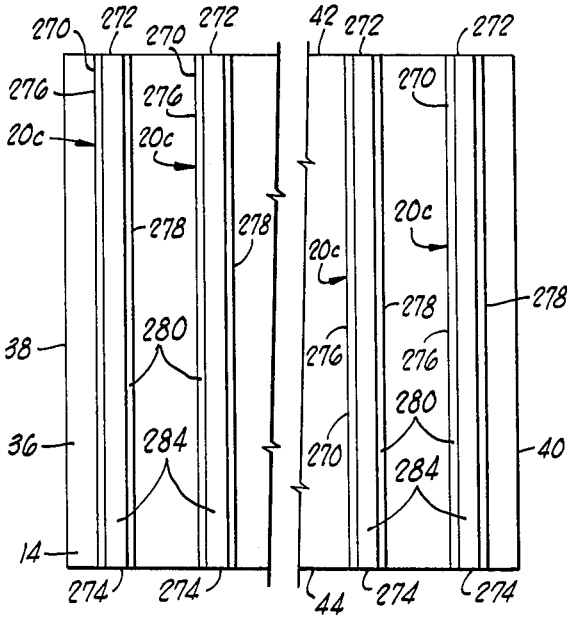
FIG. 8 is an elevational view showing the second face of the cathodic member similar to FIG. 2, but showing a portion of the modified fastener assembly partially shown in FIG. 7.
Figure 9:
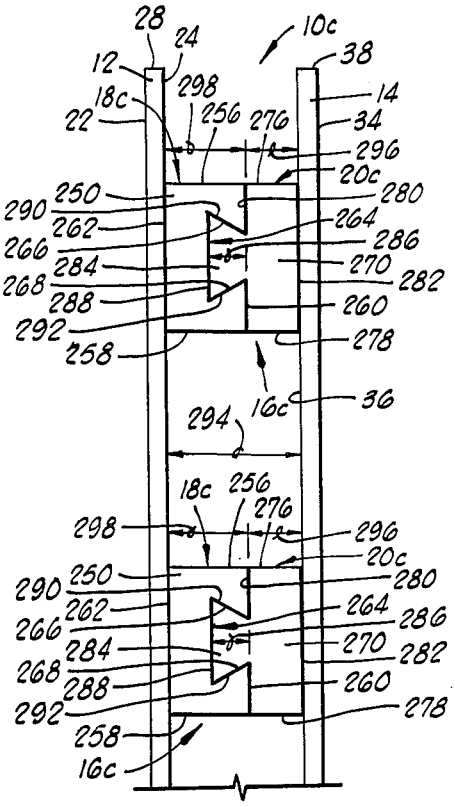
FIG. 9 is a view showing a portion of the anodic member secured to a portion of the cathodic member via the modified fastener assembly partially shown in FIGS. 7 and 8, the modified fastener assembly being enlarged and shown in elevation.

Embodiment of FIGS. 7, 8 and 9

Shown in FIGS. 7, 8 and 9 is another modified bipolar electrode 10*c* which is constructed exactly like the bipolar electrode 10 described before, except the bipolar electrode 10*c* includes a plurality of modified fastener assemblies 16*c*, each having a modified first fastener element 18*c* and a modified second fastener element 20*c*.

Each of the first fastener elements 18*c* includes a generally rectangularly shaped first base 250 having opposite ends 252 and 254, opposite sides 256 and 258, an upper surface 260 and a lower surface 262. A channel 264 is formed in a central portion of the upper surface 260 of each first base 250 and each channel 260 extends a distance through one of the first bases 250 generally toward the lower surface 262, each channel 260 also extending angularly outwardly toward the sides 256 and 258 forming angularly extending stop surfaces 266 and 268. Each channel 264 also extends between and intersects the opposite ends 252 and 254 of one of the first bases 250 and thus the angularly extending stop surfaces 266 and 268 also extend between the opposite ends 252 and 254 of the first bases 250.

The lower surfaces 262 of each first base 250 is positioned adjacent the second face 24 of the anodic member 12 and each first base 250 is disposed on the second face 24 of the anodic member 12 extending generally between the third side 30 and the fourth side 32, each first base 250 being secured to the second face 24, such as by resistance welding, for example. Each of the first bases 250 is spaced from the adjacent first bases 250, and the first bases 250 are positioned and spaced on the second face 24 of the anodic member 12 in accordance with the predetermined fastener spacing pattern for reasons like that described before with respect to the bipolar electrode 10 shown in FIGS. 1 through 4.

Each of the second fastener elements 20*c* includes a rectangular shaped second base 270 having opposite ends 272 and 274, opposite sides 276 and 278, an upper surface 280 and a lower surface 282. A key element 284 is connected to a central portion of the upper surface 280 of each of the second bases 270, each key element 284 extending generally between the opposite ends 272 and 274 and disposed generally between the opposite sides 276 and 278. The key element 284 extends a distance 286 from the upper surface 280 terminating with an outermost end 288. The key element 284 has opposite sides 290 and 292, and each of the sides 290 and 292 is angularly disposed, each side 290 and 292 extending angularly inwardly toward one of the opposite sides 290 and 292.

The lower surface 282 of each second base 270 is positioned adjacent the second face 36 of the cathodic member 14 and each second base 270 is disposed on the second face 36 of the cathodic member 14 extending generally between the third side 42 and the fourth side 44, each second base 270 being secured to the second face 36, such as by resistance welding, for example. Each of the second bases 270 is spaced from the adjacent second bases 270, and the second bases 270 are positioned and spaced on the second face 36 of the cathodic member 14 in accordance with a predetermined fastener spacing pattern for reasons like that described before with respect to the bipolar electrode 10 shown in FIGS. 1 through 4. More particularly, the second bases 270 are secured to the cathodic member 14 and spaced thereon such that each of the key elements 284 is aligned with one of the channels 264 formed in the first bases 250.

In one preferred form, the depth of the channel 264 formed in each of the first bases 250 is slightly greater than the distance 286 between the end 288 of the key element 284 and the upper surface 280 of the second base 70. Further, the angular disposition of the stop surfaces 266 and 268 formed in each of the first bases 250 is substantially the same as the angular disposition of the sides 290 and 292 formed on each of the key elements 284. In general, the key element 284 on each of the second bases 270 is shaped, sized and positioned to slidingly fit within one of the channels 264 formed in the first bases 258.

In one preferred form, each of the key elements 284 is sized to provide a sliding fit within one of the channels 264 in a manner assuring the maximum contacting engagement between the key elements 284 and the first bases 250 in an assembled position of the bipolar electrode 10*c*. This last-mentioned feature is a particularly important consideration when the fastener assemblies 16*c* are constructed of an electrically conductive material for providing electrical continuity between the anodic member 12 and the cathodic member 14.

To assemble the bipolar electrode 10*c*, one of the members 12 or 14 is disposed above the other member 12 or 14 to a position wherein the fourth side 32 or 44 of one of the members 12 or 14, respectively, is disposed a distance above the third side 30 or 42 of the other member 12 or 14, respectively, and each of the key elements 284 is substantially aligned with one of the channels 264. In this position, the elevated member 12 or 14 is moved downwardly sliding each of the key elements 284 into and through one of the channels 264 to a position wherein the members 12 and 14 are substantially aligned and each of the key elements 284 is disposed within one of the channels 264, the angularly extending stop surfaces 266 engaging the angularly extending sides 290 and 292 preventing the movement of either members 12 or 14 in one direction generally away from the other member 12 or 14 and securing the members 12 and 14 in an assembled position spaced apart a distance 294 (the distance 294 being approximately determined via the distance 296 between the upper surface 280 of each second base 270 and the second face 36 of the cathodic member 14 and the distance 298 between the upper surface 260 of each first base 250 and the second face 24 of the anodic member 12).

In one preferred embodiment, the first base 250 is constructed of titanium and the second base 270 is constructed of copper.

The first fastener element 18*c* and the second fastener element 20*c* are also constructed such that a portion of the first fastener element 18*c* engages a portion of the second fastener element 20*c* limiting the movement of the second fastener element 20*c* and the cathodic member 14 in a direction generally toward the anodic member 12 and spacing the cathodic member 14 a distance from the first fastener element 18*c* and the anodic element 12. Further, the second fastener element 20*c* engages a portion of the first fastener element 18*c* limiting the movement of the first fastener element 18*c* and the anodic member 14 in a direction generally toward the cathodic member 14 and spacing the anodic member 12 and the first fastener element 18c a distance from the cathodic member 14.

Figure 10:
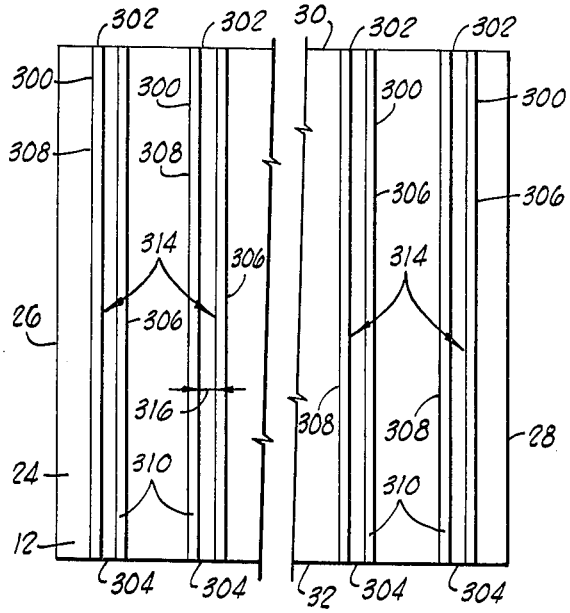
FIG. 10 is an elevational view showing the second face of the anodic member similar to FIG. 1, but showing a portion of one other modified fastener assembly.
Figure 11:
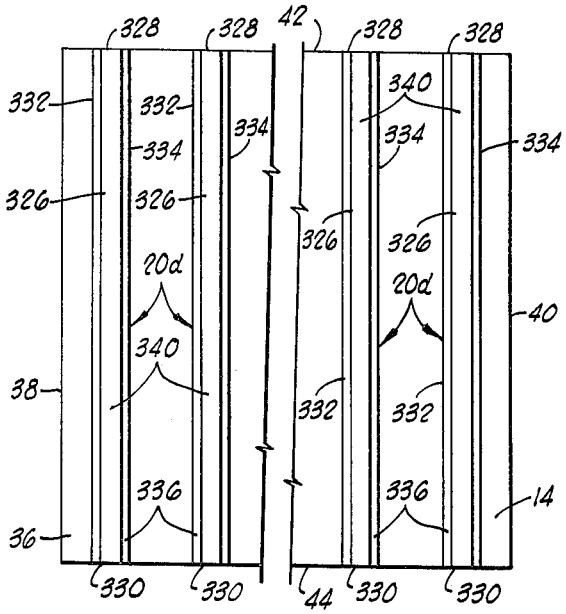
FIG. 11 is an elevational view showing the second face of the cathodic member similar to FIG. 2, but showing a portion of the modified fastener assembly partially shown in FIG. 10.
Figure 12:
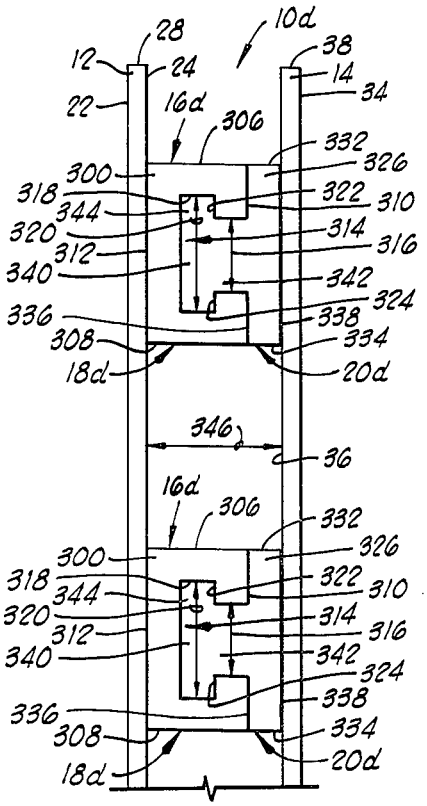
FIG. 12 is a view showing a portion of the anodic member secured to a portion of the cathodic member via the modified fastener assembly partially shown in FIGS. 10 and 11, the modified fastener assembly being enlarged and shown in elevation.

Embodiment of FIGS. 10, 11 and 12

Shown in FIGS. 10, 11 and 12 is still another modified bipolar electrode 10d which is constructed exactly like the bipolar electrode 10 described before, except the bipolar electrode 10d includes a plurality of modified fastener assemblies 16d, each having a modified first fastener element 18d and a modified second fastener element 20d.

Each of the first fastener elements 18d includes a generally rectangularly shaped first base 300 having opposite ends 302 and 304, opposite sides 306 and 308, an upper surface 310 and a lower surface 312. An elongated channel 314 is formed in a central portion of the upper surface 310 of each first base 300, and each channel extends generally between and intersects the opposite ends 302 and 304, each channel 314 forming an opening in the upper surface 310 of one of the first bases 300 having a width 316. A portion of the channel 314 is formed via an opening 318 extending through a central portion of each of the first bases 300 and each opening 318 extends generally between and intersects the opposite ends 302 and 304 of one of the first bases 300, each opening 318 having a width 320 extending generally between the opposite sides 306 and 308. The width 320 is greater than the width 316 and a pair of angularly extending stop surfaces 322 and 324 extending generally between the opposite ends 302 and 304 are formed in the first base 300. The channel 314 forms what is sometimes referred to as a "C-shaped first base 300", i.e. the first base 300 has a generally C-shaped cross-section.

The lower surface 312 of each first base 300 is positioned adjacent the second face 24 of the anodic member 12 and each first base 300 is disposed on the second face 24 of the anodic member 12 extending generally between the third side 30 and the fourth side 32, each first base 300 being secured to the second face 24, such as by resistance welding, for example. Each of the first bases 300 is spaced from the adjacent first bases 300, and the first bases 300 are positioned on the second face 24 of the anodic member 12 in accordance with a predetermined fastener spacing pattern for reasons like that described before with respect to the bipolar electrode 10 shown in FIGS. 1 through 4.

Each of the second fastener elements 20d includes a generally rectangularly shaped second base 326 having opposite ends 328 and 330, opposite sides 332 and 334, an upper surface 336 and a lower surface 338. One end of a T-shaped, key element 340, having a stem portion 342 and a cross member portion 344, is secured to a central portion of the upper surface 336, the T-shaped key element 340 extending generally between the opposite ends 328 and 330 of the second base 326. The end of the stem portion 342, opposite the end connected to the second base 326, is connected to a central portion of the cross member portion 344 and the cross member portion 344 is generally perpendicularly disposed with respect to the stem portion 342.

The lower surface 338 of each second base 326 is positioned adjacent the second face 36 of the cathodic member 14 and each second base 326 is disposed on the second face 36 of the cathodic member 14 extending generally between the third side 42 and the fourth side 44, each first base 326 being secured to the second face 36 such as by resistance welding, for example. Each of the second bases 326 is spaced from the adjacent second bases 326 and the second bases 326 are positioned and spaced on the second face 36 of the cathodic member 14 in accordance with the predetermined fastener spacing pattern for reasons like that described before with respect to the bipolar electrode 10 shown in FIGS. 1 through 4. More particularly, the second bases 326 are spaced on the cathodic members 14 such that each T-shaped key element 340 is generally aligned with one of the channels 314 in one of the first bases 300. The stem portion 342 is sized and shaped to slidingly fit with the channel 314 and the cross member portion 344 is slidingly fit within the opening 318 formed in the channel 314 to provide the mechanical interlock connection between the first base 300 and the second base 326. The first base 300 and the second base 326 are assembled in a manner similar to that described before with respect to the bipolar electrode 10c shown in FIGS. 7, 8 and 9.

In one preferred form, the first base 300 is constructed of titanium and the second base 326, including the T-shaped key element 340 connected thereto, is constructed of copper.

In one preferred form, each key element 340 is sized to slidingly fit within one of the channels 314 in a manner assuring the maximum contacting engagement between key elements 340 and the first bases 300 in an assembled position of the bipolar electrode 10d. This particular consideration is important when the fastener assemblies 16d are constructed of an electrically conductive material for providing electrical continuity between the anodic member 12 and the cathodic member 14.

In a manner similar to that described before with respect to the other fastener assemblies, the fastener assembly 16d is constructed such that a portion of the first fastener element 18d engages a portion of the second fastener element 20d limiting the movement of the second fastener element 20d and the cathodic member 14 in a direction generally toward the anodic member 12 and spacing the cathodic member 14 a distance from the first fastener element 18d and the anodic member 12. Further, the second fastener element 20d engages a portion of the first fastener element 18d limiting the movement of the first fastener element 18d and the anodic member 12 in a direction generally toward the cathodic member 14 and spacing the anodic member 12 and the first fastener element 18d a distance from the cathodic member 14. The second face 24 of the anodic member 12 is spaced a distance 346 from the second face 36 of the cathodic member 14.

Figure 13:
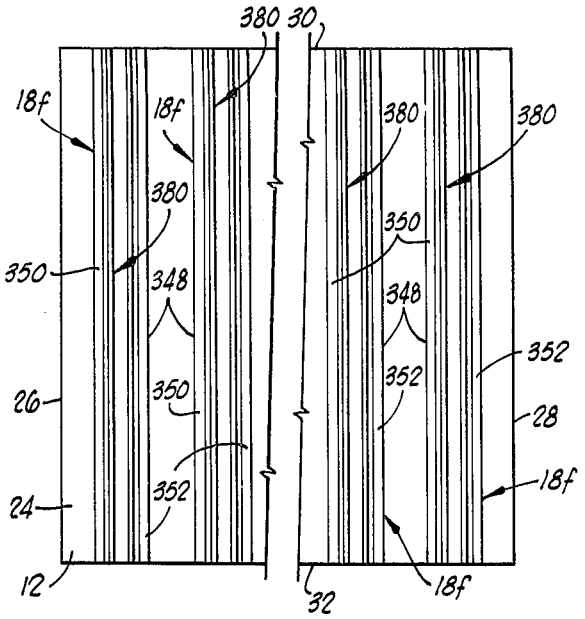
FIG. 13 is an elevational view showing the second face of the anodic member similar to FIG. 1, but showing a portion of still another modified fastener assembly.
Figure 14:
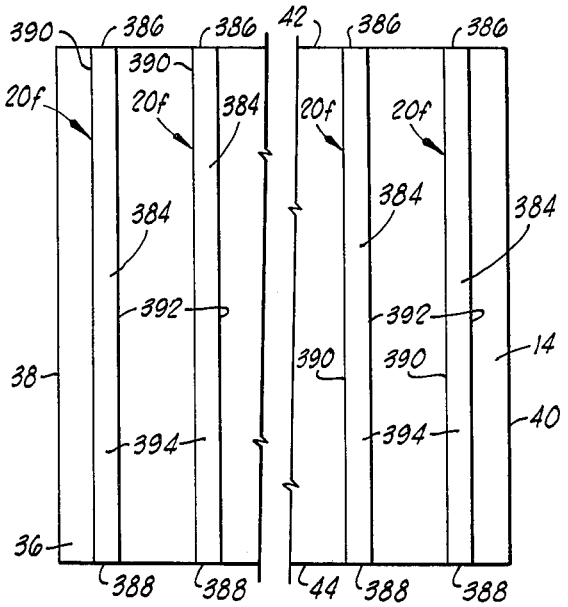
FIG. 14 is an elevational view showing the second face of the cathodic member similar to FIG. 2, but showing a portion of the modified fastener assembly partially shown in FIG. 13.
Figure 15:
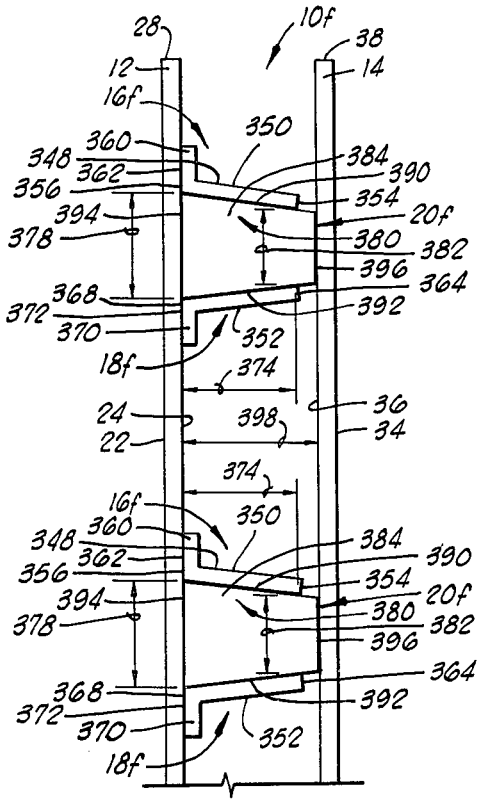
FIG. 15 is a view showing a portion of the anodic member secured to a portion of the cathodic member via the modified fastener assembly partially shown in FIGS. 13 and 14, the modified fastener assembly being enlarged and shown in elevation.

Embodiment of FIGS. 13, 14 and 15

Shown in FIGS. 13, 14 and 15 is one other modified bipolar electrode 10f which is constructed exactly like the bipolar electrode 10 described before, except the bipolar electrode 10f includes a plurality of modified fastener assemblies 16f, each having a modified first fastener element 18f and a modified second fastener element 20f.

Each of the first fastener elements 18f includes a first base 348 having a first angle flange 350 and a second angle flange 352. The first angle flange 350 has opposite ends 354 and 356, and a rim 360 is formed on the end 356 of the first angle flange 350 forming a surface 362. The second angle flange 352 has opposite ends 364 and 368 and a rim 370 is formed on the end 368 of the second angle flange 352 forming a surface 372.

In an assembled position of the first fastener element 18f, the surface 362 formed on each of the first angle flanges 350 is positioned generally adjacent the second face 24 of the anodic member 12 with the first angle flange 350 extending angularly a distance 374 from the second face 24, each of the first angle flanges 350 also extending generally between the third side 30 and the fourth side 32 of the anodic member 12. In this position, each of the first angle flanges 350 is secured to the second face 24. The surface 372 formed on each of the second angle flanges 352 is positioned generally adjacent the anodic member 12 with the second angle flange 352 extending angularly a distance 274 from the second face 24, each of the second angle flanges 352 also extending generally between the third side 30 and the fourth side 32 of the anodic member 12. In this position, each of the second angle flanges 352 is secured to the second face 24.

The first angle flange 350 is spaced a distance 378 from the second angle flange 352 forming a channel 380 therebetween. Each of the angle flanges 350 and 352 extends angularly outwardly from the second face 24 and generally toward the other angle flange 350 or 352. The ends 354 and 364 of the first and the second angle flanges 350 and 352, respectively, are spaced apart a distance 382.

Each of the second fastener elements **20*f* includes a second base 384 having opposite ends 386 and 388, opposite sides 390 and 392, and upper surface 394 and a lower surface 396. The sides 390 and 392 each extend angularly outwardly in a direction from the lower surface 396 toward the upper surface 394**.

The lower surface 204 of each second base 384 is positioned generally adjacent the second face 36 of the cathodic member 14 and each second base 384 is secured to the second face 36. Each of the second bases 384 is spaced from the adjacent second bases 384, and the second bases 384 are positioned and disposed on the second face 36 in accordance with the predetermined fastener spacing pattern for reasons like that described before with respect to the bipolar electrode 10 shown in FIGS. 1 through 4. More particularly, the second bases 384 are spaced on the cathodic member 14 such that each second base 384 is aligned with one of the channels 380 formed between the two angle flanges 350 and 352.

The second bases 284 are each sized, positioned and shaped to slidingly fit between the first and the second angle flanges 350 and 352 of one of the first fastener elements **18*f* in a manner like that described before with respect to the bipolar electrodes 10*c* and 10*d*. In the assembled position as shown in FIG. 15, the ends 354 and 364 of the angle flanges 350 and 352 are each spaced from the second face 36 for reasons described before. In one preferred embodiment, the first and the second angle flanges 350 and 352 are constructed of titanium and the second base 384 is constructed of copper and the second face 24 of the anodic member 12 is spaced a distance 398 from the second face 36 of the cathodic member 14**.

Each of the second bases 384 is sized to slidingly fit within one of the channels 380 in a manner assuring the maximum contacting engagement between the second bases 384 and the first and the second angle flanges 350 and 352 in an assembled position of the bipolar electrode **10*f*. This consideration is particularly important when the fastener assemblies 16*f* are constructed of an electrically conductive material for providing electrical continuity between the anodic member 12 and the cathodic member 14**.

It should be noted that each of the bipolar electrodes **10*a*, 10*b*, 10*c*, 10*d* and 10*f* includes the seal member 130 engaging portions of the anodic member 12 and the cathodic member 14 for sealing a substantial portion of the electrolyte from the space between the anodic member 12 and the cathodic member 14. In some applications, it may be necessary to space the ends 252 and 254 of the first bases 250 a distance from the third and the fourth sides 30 and 32 of the anodic member 12 and to space the ends 272 and 274 of the second bases 270 a distance from the third and the fourth sides 42 and 44 of the cathodic member 14, the first bases 250 also being spaced a distance from the first and the second sides 26 and 28 and the second bases 270 also being spaced a distance from the first and the second sides 38 and 40. The spacing of the bases from the sides provides a space for accommodating portions of the seal member which may be desirable depending on the particular construction of the seal member. In a similar manner, the bases 300 and 326 and the bases 348 and 384** may be spaced from the sides of the anodic member and the cathodic member to accommodate portions of the seal member.

Again, it should be noted that the fastener assemblies are constructed to mechanically interconnect the anodic member and the cathodic member in a spaced apart relationship wherein the anodic member and those portions of the fastener assembly constructed of titanium are spaced a distance from the cathodic member. The spacing between the anodic member and the cathodic member substantially inhibits the migration of hydrogen from the cathodic member to the anodic member and substantially reduces the possibility of hydrogen attacking the anodic member causing warping or deformation of the anodic member and such other effects as hydrogen embrittlement, for example. These latter-mentioned aspects of the present invention are particularly applicable when the bipolar electrodes are utilized in an alkali chloride type of electrolysis application.

Finally, it should be noted that, although the first fastener elements have been described herein as being connected to the anodic member and the second fastener elements have been described herein as being connected to the cathodic member, the present invention also contemplates fastener assemblies having the first fastener elements connected to the cathodic member and second fastener elements connected to the anodic member. In these last-mentioned embodiments, the fastener element connected to the anodic member is constructed of the materials described above in connection with the fastener elements connected to the anodic member and the fastener element connected to the cathodic member is constructed of the materials described above in connection with the fastener elements connected to the cathodic member.

Changes may be made in the construction and the arrangement of the various parts or the elements of the embodiments disclosed herein or in the steps of the method disclosed herein without departing from the spirit and the scope of the invention as defined in the following claims.

What is claimed is:

1. A bipolar electrode, comprising:

an anodic member having a first face and a second face;

a cathodic member having a first face and a second face, the second face of the cathodic member generally facing the second face of the anodic member and being spaced a distance therefrom;

a fastener assembly disposed between the anodic member and the cathodic member, having a portion connected to the second face of the anodic member and another portion connected to the second face of the cathodic member, the fastener assembly mechanically connecting the anodic member and the cathodic member in a fastened position and having a portion constructed of an electrically conductive material electrically connecting the anodic member and the cathodic member in series in a fastened position of the fastener assembly; and seal means having a portion engaging the anodic member and a portion engaging the cathodic member forming a seal between the cathodic member and the anodic member to substantially seal electrolyte from a portion of the space between the anodic member and the cathodic member.

2. The bipolar electrode of claim 1 defined further to include a plurality of fastener assemblies, each fastener assembly disposed between the anodic member and the cathodic member, having a portion connected to the second face of the anodic member and another portion connected to the second face of the cathodic member, each fastener assembly mechanically connecting and establishing electrical continuity between the anodic member and the cathodic member, the fastener assemblies being spaced to establish a substantially uniform current density on the anodic member and the cathodic member.

3. The bipolar electrode of claim 1 wherein the fastener assembly is defined further as maintaining the spaced relationship between the anodic member and the cathodic member preventing contacting engagement between the second face of the anodic member and the second face of the cathodic member.

4. The bipolar electrode of claim 1 wherein the fastener assembly is defined further to include:

a first fastener element having a portion connected to the second face of the anodic member; and a second fastener element having a portion connected to the second face of the cathodic member, the second fastener element being connectable to the first fastener element, the second fastener element being connected to the first fastener element in the fastened position of the fastener assembly.

5. The bipolar electrode of claim 4 wherein the first fastener element includes a portion engageable with a portion of the second fastener element limiting the movement of the second fastener element in a direction generally toward the anodic member and spacing the second fastener element a distance from the anodic member, thereby preventing contacting engagement between the second fastener element and the anodic member.

6. The bipolar electrode of claim 4 wherein the second fastener element includes a portion engageable with a portion of the first fastener element limiting the movement of the first fastener element in a direction generally toward the cathodic member and spacing the first fastener element a distance from the cathodic member, thereby preventing contacting engagement between the first fastener element and the cathodic member.

7. The bipolar electrode of claim 4 wherein the anodic member comprises a titanium metal having a coating of a material forming an anodic surface on the first face of the anodic member; and wherein the first fastener element is constructed of a material comprising a titanium metal, the first fastener element being spaced a distance from the second face of the cathodic member for substantially reducing the possibility of hydrogen attacking the anodic member when utilizing the bipolar electrode in an electrolysis application having an electrolyte reacting with the cathodic member to form hydrogen.

8. The bipolar electrode of claim 7 wherein the material forming the anodic surface on the anodic member is defined further as being a noble metal selected from the group consisting of platinum, iridium, platinum-iridium, rubidium, ruthenium, osmium and oxides thereof.

9. The bipolar electrode of claim 7 wherein the second fastener element includes a portion constructed of copper, the portion constructed of copper contacting a portion of the first fastener element establishing electrical continuity therebetween.

10. The bipolar electrode of claim 4 wherein the second fastener element is defined further as being threadedly connectable to the first fastener element.

11. The bipolar electrode of claim 4 wherein the second fastener element is defined further as being slidingly connectable to the first fastener element.

12. The bipolar electrode of claim 1 wherein the fastener assembly is defined further to include:

a first fastener element having a portion connected to the second face of one of the anodic member and the cathodic member;

a second fastener element having a portion connected to the second face of the one of the cathodic member and the anodic member, opposite the one of the cathodic member and the anodic member having the first fastener element connected thereto, a portion of the second fastener element being connectable to a portion of the first fastener element, the second fastener element being connected to the first fastener element in the fastened position of the fastener assembly.

13. The bipolar electrode of claim 12 wherein the first fastener element is defined further to include:

a first base connected to the second face of the one of the anodic member and the cathodic member having the first fastener element connected thereto, the first base having an upper surface and a lower surface, the lower surface of the first base being positioned generally near the second face of the one of the anodic member and the cathodic member having the first fastener element connected thereto and the upper surface of the first base being spaced a distance from the second face of the one of the anodic member and the cathodic member having the first fastener element connected thereto; and wherein the second fastener element is defined further to include:

a second base connected to the second face of the one of the anodic member and the cathodic member having the second fastener element connected thereto, the second base having an upper surface and a lower surface, the lower surface of the second base being positioned generally near the second face of the one of the anodic member and the cathodic member having the second fastener element connected thereto and the upper surface of the second base being spaced a distance from the second face of the one of the anodic member and the cathodic member having the second fastener element connected thereto, the second base being connectable to the first base in a fastened position of the fastener assembly.

14. The bipolar electrode of claim 13 wherein the first fastener element is connected to the anodic member and the second fastener element is connected to the cathodic member; and wherein the first base includes a portion engageable with a portion of the second fastener element limiting the movement of the second fastener element and the cathodic member connected thereto in a direction generally toward the second face of the anodic member and spacing the second fastener element and the cathodic member connected thereto a distance from the second face of the anodic member.

15. The bipolar electrode of claim 13 wherein the first fastener element is connected to the anodic member and the second fastener element is connected to the cathodic member; and wherein the first base includes a portion engageable with a portion of the second fastener assembly limiting the movement of the first fastener element and the anodic member connected thereto in a direction generally toward the second face of the cathodic member and spacing the first fastener element and the anodic member connected thereto a distance from the second face of the cathodic member.

16. The bipolar electrode of claim 13 wherein the second base includes a recess formed in the upper surface thereof extending a distance into the second base generally toward the lower surface of the second base; and wherein the first fastener element includes:

a rod, having an outer peripheral surface and opposite ends, one end of the rod connected to the upper surface of the first base and extending a distance therefrom, the rod being insertable into the recess formed in the second base and a portion of the rod engaging a portion of the second base for connecting the first and the second bases.

17. The bipolar electrode of claim 16 wherein the recess in the second base is defined further as being shaped to receive the rod and to establish a force-fit between the rod and the second base in the fastened position with the rod inserted into the recess formed in the second base.

18. The bipolar electrode of claim 13 wherein the first fastener element is defined further to include:

a first threaded member having opposite ends, one end of the threaded member being connected to the upper surface of the first base and the first threaded member extending a distance from the upper surface of the first base; and wherein the second fastener element is defined further to include:

a second threaded member having opposite ends, one end of the second threaded member being connected to the upper surface of the second base and the second threaded member extending a distance from the upper surface of the second base; and wherein the fastener assembly is defined further to include:

a nipple having opposite ends and a threaded opening formed in each of the opposite ends, each threaded opening extending a distance generally through the nipple, the first threaded member being disposed a distance through the threaded opening formed in one end of the nipple and the nipple threadedly engaging the first threaded member, the second threaded member being disposed a distance through the threaded opening formed in the end of the nipple, opposite the end of the nipple having the first threaded member disposed therethrough, and the nipple threadedly engaging the second threaded member, the first and the second fastener elements being connected in the fastened position via the threaded engagement between the nipple and the first and the second threaded members.

19. The bipolar electrode of claim 18 wherein the first fastener element is connected to the anodic member and wherein the second fastener element is connected to the cathodic member and wherein the first base includes a portion engaging one end of the nipple limiting the movement of the second fastener element and the cathodic member connected thereto in a direction generally toward the second face of the anodic member and spacing the second fastener element and the cathodic member connected thereto a distance from the second face of the anodic member.

20. The bipolar electrode of claim 18 wherein the first fastener element is connected to the anodic member and wherein the second fastener element is connected to the cathodic member and wherein the second base includes a portion engaging one end of the nipple limiting the movement of the first fastener element and the anodic member connected thereto in a direction generally toward the second face of the cathodic member and spacing the first fastener element and the anodic member connected thereto a distance from the second face of the cathodic member.

21. The bipolar electrode of claim 13 wherein the first base includes a threaded opening formed in the upper surface of the first base and extending a distance axially therethrough; and wherein the second base includes a threaded opening formed in the upper surface of the second base and extending a distance therethrough; and wherein the fastener assembly is defined further to include:

a threaded member having opposite ends, a portion of the threaded member near each of the opposite ends being threaded, one end of the threaded member being disposed a distance through the threaded opening in the first base and the opposite end of the threaded member being disposed a distance through the threaded opening in the second base, the threaded portions of the threaded member threadedly engaging the first and the second bases and the first and the second fastener elements being connected in the fastened position via the threaded engagement between the threaded member and the first and the second bases.

22. The bipolar electrode of claim 21 wherein the first fastener element is connected to the anodic member and the second fastener element is connected to the cathodic member; and wherein the threaded opening in the first base extends therethrough intersecting the upper and the lower surfaces of the first base; and wherein one end of the threaded member engages the second face of the anodic member limiting the movement of the second fastener element and the cathodic member connected thereto in a direction generally toward the second face of the anodic member and spacing the second fastener element and the cathodic member connected thereto a distance from the second face of the anodic member.

23. The bipolar electrode of claim 21 wherein the first fastener element is connected to the anodic member and the second fastener element is connected to the cathodic member and wherein the first fastener element and the anodic member connected thereto are spaced a distance from the second face of the cathodic member in a fastened position of the fastener assembly.

24. The bipolar electrode of claim 13 wherein the first base includes opposite ends and a channel formed in the upper surface extending generally between the opposite ends of the first base and intersecting at least one of the opposite ends of the first base, a portion of the channel forming a stop surface in the first base; and wherein the second base includes opposite ends; and wherein the second fastener element is defined further to include: a key element connected to the upper surface of the second base and extending a distance therefrom terminating with an outermost end, the key element being slidably insertable into the channel formed in the first base, a portion of the key element engaging the stop surface formed in the first base and the key element being retained within the channel via the engagement between the key element and the stop surface formed in the first base.

25. The bipolar electrode of claim 24 wherein the key element includes opposite sides, at least one of the opposite sides being formed at an angle extending inwardly from the outermost end of the key element generally toward the second base; and wherein the stop surface formed via the channel in the second base extends angularly outwardly from the upper surface generally toward the lower surface of the second base, the angularly extending stop surface in the second base engaging the angularly extending side formed on the first base and the key element being retained in one direction within the channel in the first base.

26. The bipolar electrode of claim 25 wherein the anodic member includes a first side, a second side, a third side and a fourth side; and wherein the cathodic member includes a first side, a second side, a third side and a fourth side; and wherein the first base extends a distance generally between the third and the fourth sides of the one of the anodic member and the cathodic member having the first fastener element connected thereto; and wherein the second base extends a distance generally between the third and the fourth sides of the one of the anodic member and the cathodic member having the second fastener element connected thereto.

27. The bipolar electrode of claim 25 wherein the first fastener element is connected to the anodic member and the second fastener element is connected to the cathodic member; and wherein the second fastener element and the cathodic member connected thereto are spaced a distance from the second face of the anodic member in a fastened position of the fastener assembly.

28. The bipolar electrode of claim 25 wherein the first fastener element is connected to the anodic member and the second fastener element is connected to the cathodic member; and wherein the first fastener element and the anodic member connected thereto are spaced a distance from the second face of the cathodic member in a fastened position of the fastener assembly.

29. The bipolar electrode of claim 13 wherein the first base is defined further to include:

a first angle flange having opposite ends, one end of the first angle flange being connected to and extending a distance from the second face of the one of the anodic member and the cathodic member having the first fastener element connected thereto;

a second angle flange having opposite ends, one end of the angle flange being connected to and extending a distance from the second face of the one of the anodic member and the cathodic member having the second fastener element connected thereto, the second angle flange being spaced from the first angle flange thereby forming a channel therebetween; and wherein the second base is defined further to include opposite ends, a portion of the second base being slidingly disposable within the channel formed via the first and the second angle flanges and a portion of the second base engaging a portion of the first and the second angle flanges, the second base being retained in one direction within the channel formed via the first and the second angle flanges via the engagement between the second base and the first and the second angle flanges.

30. An improved electrolytic cell having electrodes connected to an electrical power source and at least partially immersed in an electrolyte wherein the electrolytic cell includes at least one bipolar electrode including an anodic member having a first face and a second face and a cathodic member having a first face and a second face, the improvement comprising:

a fastener assembly disposed between the second face of the anodic member and the second face of the cathodic member of each bipolar electrode in the electrolytic cell, each fastener assembly having a portion connected to the second face of the anodic member and the second face of the cathodic member of one of the bipolar electrodes, and each fastener assembly mechanically connecting the anodic member and the cathodic member and spacing the second face of the anodic member a distance from the second face of the cathodic member in one of the bipolar electrodes in the electrolytic cell, a portion of the fastener assembly being constructed of an electrically conductive material establishing electrical continuity between the anodic member and the cathodic member in a fastened position of the fastener assembly; and means for substantially sealing electrolyte from a substantial portion of the space between the second face of the anodic member and the second face of the cathodic member.

* * * * *